US009437933B2

(12) United States Patent
Georgescu et al.

(10) Patent No.: US 9,437,933 B2
(45) Date of Patent: Sep. 6, 2016

(54) SENSOR DEVICE WITH HELICAL ANTENNA AND RELATED SYSTEM AND METHOD

(75) Inventors: Ion Georgescu, Bucharest (RO); Dana E. Guran, Bucharest (RO); Ioan Pavelescu, Bucharest (RO); Cornel Cobianu, Bucharest (RO)

(73) Assignee: Honeywell International Inc., Morris Plains, NJ (US)

( * ) Notice: Subject to any disclaimer, the term of this patent is extended or adjusted under 35 U.S.C. 154(b) by 1108 days.

(21) Appl. No.: 12/755,123

(22) Filed: Apr. 6, 2010

(65) Prior Publication Data

US 2011/0241959 A1 Oct. 6, 2011

(51) Int. Cl.

| | |
|---|---|
| ***H01Q 11/08*** | (2006.01) |
| ***H01Q 1/38*** | (2006.01) |
| *H01Q 1/32* | (2006.01) |

(52) U.S. Cl.

CPC ..... *H01Q 11/08* (2013.01); *H01Q 1/38* (2013.01); *H01Q 1/3233* (2013.01)

(58) Field of Classification Search

CPC ..... H01Q 1/38; H01Q 11/02; H01Q 11/08
USPC ..... 343/793, 895, 796; 216/18
See application file for complete search history.

(56) References Cited

U.S. PATENT DOCUMENTS 4,242,671 A * 12/1980 Plows ..... 367/2
5,479,182 A 12/1995 Sydor
6,501,437 B1 * 12/2002 Gyorko et al. ..... 343/895
6,593,900 B1 7/2003 Craven et al.
6,618,023 B2 * 9/2003 Park ..... 343/895
6,650,303 B2 * 11/2003 Kim et al. ..... 343/895

(Continued)

FOREIGN PATENT DOCUMENTS

RO A2008-00302 12/2009
WO WO 02/13309 A1 2/2002

(Continued)

OTHER PUBLICATIONS

G. Collin, A. Chami, C. Luxey, P. Le Thuc, and R. Staraj, "Human implanted spiral antenna for a 2.45 GHz wireless temperature and pressure SAW sensor system," Proceedings of 2008 IEEE AP-S International Symposium and USNC/URSI National Radio Science Meeting, San Diego, CA, USA, Jul. 2008.*

(Continued)

*Primary Examiner* — Sue A Purvis
*Assistant Examiner* — Amal Patel

(57) ABSTRACT

An apparatus includes a sensor that receives a first electrical signal and provides a second electrical signal in response to the first electrical signal. The second electrical signal is based on at least one parameter monitored by the sensor. The apparatus also includes an antenna that converts first wireless signals into the first electrical signal and that converts the second electrical signal into second wireless signals. The antenna includes a substrate, conductive traces, and conductive interconnects. The conductive traces are formed on first and second surfaces of the substrate. The conductive interconnects couple the conductive traces, and the conductive interconnects and the conductive traces form at least one helical arm of the antenna. The conductive traces could be formed in various ways, such as by etching or direct printing. The conductive interconnects could also be formed in various ways, such as by filling vias in the substrate or direct printing.

19 Claims, 4 Drawing Sheets

(56) References Cited

U.S. PATENT DOCUMENTS

| | | | | |
|---|---|---|---|---|
| 7,355,558 | B2 * | 4/2008 | Lee | 343/895 |
| 2002/0126049 | A1 * | 9/2002 | Okabe | H01Q 1/243 343/700 MS |
| 2007/0164859 | A1 | 7/2007 | Cobianu et al. | |
| 2007/0285335 | A1 * | 12/2007 | Bungo et al. | 343/895 |

FOREIGN PATENT DOCUMENTS

WO WO 2007/061831 A1 5/2007

WO WO 2009134243 A1 * 11/2009

OTHER PUBLICATIONS

Martin, G.; Berthelot, P.; Masson, J.; Daniau, W.; Blondeau-Patissier, V.; Guichardaz, B.; Ballandras, S.; Lamber, A., "Measuring the inner body temperature using a wireless temperature SAW-sensor-based system," Ultrasonics Symposium, 2005 IEEE , vol. 4, No., pp. 2089,2092, Sep. 18-21, 2005.*

* cited by examiner

SENSOR DEVICE WITH HELICAL ANTENNA AND RELATED SYSTEM AND METHOD

TECHNICAL FIELD

This disclosure relates generally to wireless sensors and more specifically to a sensor device with a helical antenna and related system and method.

BACKGROUND

Wireless monitoring is becoming more and more important in various applications, such as in industrial process automation systems and asset monitoring and control systems. In these types of monitoring applications, wireless sensors can be used to measure physical, chemical, or other parameters in inaccessible, hazardous, or other areas. Example aspects that can be monitored include the force, pressure, or torque of a rotating shaft, the temperature of moving or rotating parts, or the identification of marks on products or other objects. Among other things, wireless sensors could be used to support real-time control of an industrial process.

Many conventional wireless sensing applications are based on the use of battery-powered sensors, which increase the size and weight of the sensors. For large sensor networks, power management operations related to on-time battery replacement are often a costly and time-consuming task. As a result, wireless sensors that operate without batteries are emerging for real-time process control and other applications.

SUMMARY

This disclosure provides a sensor device with a helical antenna and related system and method.

In a first embodiment, an apparatus includes a sensor configured to receive a first electrical signal and to provide a second electrical signal in response to the first electrical signal. The second electrical signal is based on at least one parameter monitored by the sensor. The apparatus also includes an antenna configured to convert first wireless signals into the first electrical signal and to convert the second electrical signal into second wireless signals. The antenna includes a substrate, a plurality of conductive traces, and a plurality of conductive interconnects. The conductive traces are formed on first and second surfaces of the substrate. The conductive interconnects couple the conductive traces, and the conductive interconnects and the conductive traces form at least one helical arm of the antenna.

In particular embodiments, the conductive traces and the conductive interconnects form two helical arms of a dipole antenna.

In other particular embodiments, the conductive traces and the conductive interconnects form one helical arm of a monopole antenna. Also, the antenna further includes at least one ground plate coupled to at least one of the conductive traces. The antenna could include multiple ground plates, and at least one additional conductive interconnect could couple the multiple ground plates.

In yet other particular embodiments, the conductive interconnects include conductive material in vias formed through the substrate and/or conductive material on sides of the substrate (where the sides are between the first and second surfaces).

In still other particular embodiments, the sensor includes a surface acoustic wave (SAW) sensor.

In a second embodiment, a method includes forming a plurality of conductive traces on first and second surfaces of a substrate. The method also includes forming a plurality of conductive interconnects coupling the conductive traces to form at least one helical arm of an antenna.

In particular embodiments, forming the conductive traces includes depositing conductive material on the first and second surfaces of the substrate and etching the conductive material to form the conductive traces.

In other particular embodiments, forming the conductive interconnects includes forming vias through the substrate and depositing conductive material in the vias to form the conductive interconnects.

In yet other particular embodiments, forming the conductive traces includes directly printing conductive material onto the first and second surfaces of the substrate to form the conductive traces.

In still other particular embodiments, forming the conductive interconnects includes directly printing conductive material onto sides of the substrate to form the conductive interconnects.

In a third embodiment, a system includes a sensor device configured to receive first wireless signals and to transmit second wireless signals in response to the first wireless signals. The sensor device includes an antenna. The antenna includes a substrate, a plurality of conductive traces, and a plurality of conductive interconnects. The conductive traces are formed on first and second surfaces of the substrate, the conductive interconnects couple the conductive traces, and the conductive interconnects and the conductive traces form at least one helical arm of the antenna. The system also includes a sensor monitor configured to transmit the first wireless signals to the sensor and to receive the second wireless signals from the sensor.

In particular embodiments, the system further includes a controller configured to analyze data associated with the second wireless signals and to control a process system based on the analysis.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 7, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
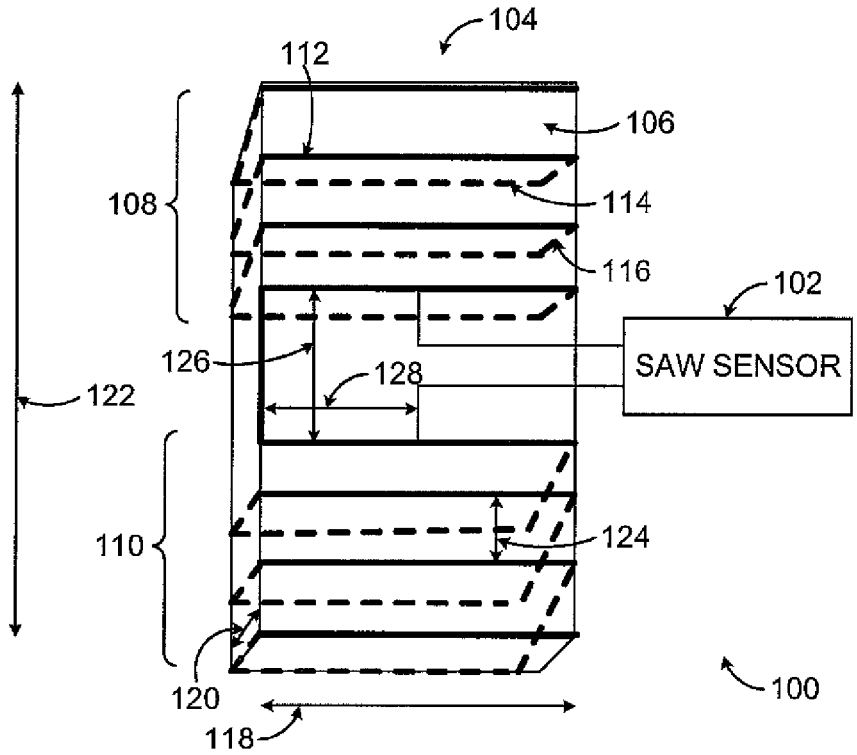
FIGS. 1 through 3 illustrate example sensor devices with helical antennas according to this disclosure.
Figure 2:
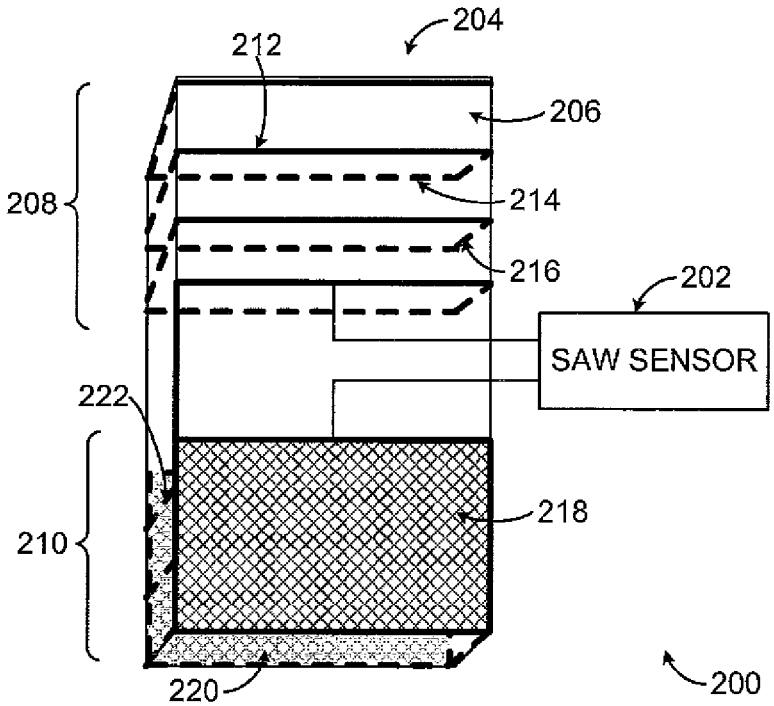
Figure 3:
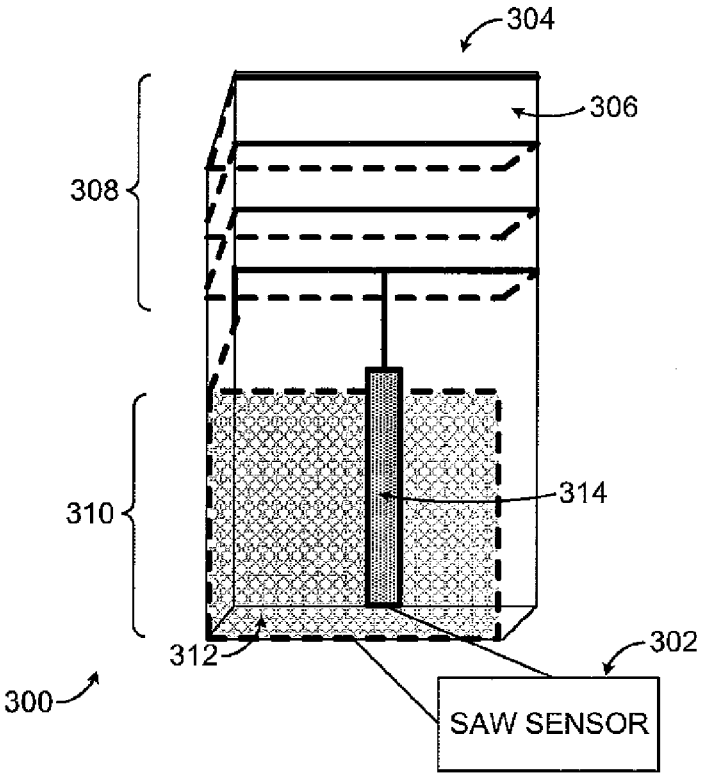

FIGS. 1 through 3 illustrate example sensor devices with helical antennas according to this disclosure. The embodiments of the sensor devices shown in FIGS. 1 through 3 are for illustration only. Other embodiments of the sensor devices could be used without departing from the scope of this disclosure.

In general, the sensor devices shown in FIGS. 1 through 3 operate using helical antennas formed in or around a substrate. The helical antennas could represent antennas with low size, good gain, and good matching features. These helical antennas could be easily implemented in sensing applications such as wireless sensors networks (like for structural health monitoring of assets or moving parts), passive radio frequency identification ("RFID") systems, or other systems. In addition, these types of helical antennas could be easily designed or modified to provide the desired characteristics for specific applications.

As shown in FIG. 1, a sensor device 100 includes a surface acoustic wave ("SAW") based sensor 102 and a helical antenna 104. The SAW-based sensor 102 represents any suitable sensor that operates using surface acoustic waves. For example, wireless signals can be received by the antenna 104, such as from an external interrogation unit. The wireless signals are converted with high gain into an electrical signal by the antenna 104. By the piezoelectric effect, the SAW-based sensor 102 converts the electrical signal in mechanical waves, which propagate on the surface of a piezoelectric substrate in the SAW-based sensor 102. The mechanical waves interact with one or more external parameters to be measured, which alters the mechanical waves. The SAW-based sensor 102 converts the mechanical waves back into an electrical signal (which at this point is carrying information about the one or more external parameters), and the electrical signal is converted with high gain back into wireless signals by the antenna 104. The wireless signals can then be received by the external interrogation unit or other device or system, which analyzes the wireless signals to identify the information about the one or more external parameters. In this way, the wireless signals provided by the SAW-based sensor 102 generally represent an "echo" of the wireless signals received by the SAW-based sensor 102, and the echo includes information about one or more conditions, materials, or other parameters being measured.

The SAW-based sensor 102 includes any suitable structure that uses the piezoelectric effect to generate signals indicative of one or more parameters to be measured. Any suitable conditions, materials, or other parameters could be measured using the SAW-based sensor 102. Examples include any suitable physical-chemical parameter, such as pressure, temperature, torque, force, or gas concentration. In these or other embodiments, the SAW-based sensor 102 could represent a sensor that operates without requiring the use of an internal battery. This helps to reduce or eliminate the need for power management operations to monitor the condition of and schedule the replacement of sensor batteries.

The antenna 104 in this example is a dipole helical antenna that includes a substrate 106 and two antenna arms 108-110. The substrate 106 generally represents any suitable substrate on which the antenna 104 could be formed. The substrate 106 could, for example, be a rigid or flexible substrate formed from material(s) with a high dielectric constant. As a particular example, the substrate 106 could represent a printed circuit board, where both major surfaces of the printed circuit board (and optionally its sides) can be used to form the antenna 104. As other particular examples, the substrate 106 could be formed from FR4, KAPTON, or other suitable material(s). In general, the thickness and dielectric constant of the substrate 106 could be selected depending on the particular needs of the antenna 104.

The antenna arms 108-110 represent the conductive portions of the antenna 104 that can receive wireless signals and convert the wireless signals into electrical energy for the SAW-based sensor 102. The antenna arms 108-110 also represent the conductive portions of the antenna 104 that can receive electrical signals from the SAW-based sensor 102 and convert the electrical signals into wireless signals. The antenna arms 108-110 are generally helical in shape, meaning the antenna arms coil or rotate around a central axis or area.

As shown in FIG. 1, each of the antenna arms 108-110 includes traces 112 on one surface of the substrate 106 and traces 114 on an opposing surface of the substrate 106. Each of the antenna arms 108-110 also includes conductive interconnects 116 that couple the traces 112-114 together. As shown here, the traces 112-114 and the interconnects 116 in the antenna arm 108 form one helical path, and the traces 112-114 and the interconnects 116 in the antenna arm 110 form another helical path. In this way, the antenna arms 108-110 have a relatively long overall length, but the antenna arms 108-110 are formed in a relatively small space.

The antenna 104 could be formed from any suitable material or materials, such as one or more conductive materials like copper. Also, the antenna 104 could be formed in any suitable manner. For example, in some embodiments, the traces 112-114 could be formed by depositing and etching conductive material(s) on the surfaces of the substrate 106. In other embodiments, the traces 112-114 could be formed by directly printing conductive material(s) onto surfaces of the substrate 106. As another example, the interconnects 116 could be formed using any suitable via formation process (such as etching or ultrasonic, mechanical, or laser drilling) to form vias through the substrate 106, followed by a process to fill the vias with conductive material(s). The interconnects 116 could also be formed by directly printing conductive material(s) onto sides of the substrate 106.

The SAW-based sensor 102 could be coupled to the antenna 104 using any suitable type of electrical connection(s). For example, coaxial cables could be used to couple the SAW-based sensor 102 to the antenna 104. As another example, the SAW-based sensor 102 could be mounted directly on the antenna 104, such as when the SAW-based sensor 102 is mounted on the substrate 106 and electrical connections between the SAW-based sensor 102 and the traces 112 are formed. Soldering, surface mount technology, and flip-chip mounting are example ways that the SAW-based sensor 102 could be mounted on the substrate 106.

The antenna 104 shown in FIG. 1 can be designed to have appropriate tuning, matching, or other characteristics for a particular application. For example, various attributes of the antenna 104 could be adjusted to provide desired tuning and matching characteristics. These attributes could include the actual thickness of the traces 112-114 on the substrate 106, the overall width 118 of the traces 112-114 across the substrate 106, the overall height 120 of the conductive interconnects 116, and the overall length 122 of the antenna 104 on the substrate 106. These attributes could also include the distance 124 between individual traces 112 or 114, the distance 126 between antenna arms 108-110, and the distance 128 between one side of the antenna 104 and the sensor's feed point on the antenna 104.

Any of these attributes could be selected or altered to provide desired functionality by the antenna 104. As particular examples, the resonance frequency of the antenna 104 can be modified by changing the width 118 of the traces 112-114, and the antenna gain can be adjusted by changing the distance 124 between traces 112 or 114 (the distance 124 between traces could be constant or variable depending on particular needs). Impedance matching with the SAW-based sensor 102 could be realized by modifying the loop size (the distance 128 between one side of the antenna 104 and the sensor's feed point). In general, simulations could be performed to develop models, and the models could be used to facilitate design of an antenna layout in terms of arm length and loop size to obtain desired tuning and matching properties for a given SAW-based sensor 102. This can be useful since SAW-based sensors and other sensors can be sensitive to antenna parameters.

The design, fabrication, and use of the antenna 104 could provide various benefits depending on the implementation. For example, the antenna 104 could be designed to have any suitable characteristics or properties, such as those needed or desired for a given SAW-based sensor 102 or application. Also, the antenna 104 could be fabricated using low-cost techniques, reducing the cost of the antenna 104 and the overall sensor device 100. Further, the antenna 104 can provide a high gain while having a compact size. In addition, the antenna 104 could have good matching and tuning properties.

As shown in FIG. 2, a sensor device 200 includes a SAW-based sensor 202 and an antenna 204. The SAW-based sensor 202 represents any suitable sensor that operates using surface acoustic waves. The antenna 204 in this example is a monopole helical antenna that includes a substrate 206, one antenna arm 208, and a ground plane 210. The antenna arm 208 is helical in shape and similar to the antenna arms 108-110 in FIG. 1. The antenna arm 208 includes traces 212-214 on opposing sides of the substrate 206 coupled by conductive interconnects 216.

The ground plane 210 in the antenna 204 of FIG. 2 includes two ground plates 218-220. Each of the ground plates 218-220 in this example represents a larger rectangular conductive surface (although any other suitable shape could be used). Conductive interconnects 222 electrically couple the ground plates 218-220 together. The ground plates 218-220 and the conductive interconnects 222 could be formed from any suitable material(s), such as one or more conductive materials like copper. Also, the ground plates 218-220 could be formed in any suitable manner, such as by depositing and etching conductive material(s) or by directly printing the conductive material(s) on the surfaces of the substrate 206. In addition, the conductive interconnects 222 could be formed in any suitable manner, such as by forming and filling vias with conductive material(s) or directly printing the conductive material(s) on the sides of the substrate 206.

Although not shown, one or more of the ground plates 218-220 could be electrically coupled to neighboring metallic parts or other conductive components in an area where the sensor device 200 is installed or used. This could help to increase the effective size of the ground plates 218-220, thereby forming an extended ground plane that can help to increase overall antenna performance (such as in critical applications where small dimensions are needed).

As shown in FIG. 3, a sensor device 300 includes a SAW-based sensor 302 and an antenna 304. The SAW-based sensor 302 represents any suitable sensor that operates using surface acoustic waves. The antenna 304 in this example is a monopole helical antenna that includes a substrate 306, one antenna arm 308, and a ground plane 310. The substrate 306 and the antenna arm 308 may be the same as or similar to corresponding components in FIGS. 1 and 2. Also, the ground plane 310 could be the same as or similar to the ground plane in FIG. 2 (and can include one or multiple ground plates 312).

In this example, the SAW-based sensor 302 is coupled to the ground plate 312 directly and to the antenna arm 308 by a microstrip connecting line 314. The microstrip connecting line 314 generally represents a conductive pad or other structure to which the SAW-based sensor 302 could be electrically coupled. In some embodiments, the microstrip connecting line 314 could be printed or otherwise formed on the substrate 306, and the SAW-based sensor 302 can be mounted on or otherwise coupled to the microstrip connecting line 314.

As with the sensor device 100 of FIG. 1, the sensor devices 200 and 300 shown in FIGS. 2 and 3 can be modified or designed for use in specific applications. For example, various dimensions of the traces, interconnects, and ground plates in the antennas 204 and 304 can be adjusted so that the antennas 204 and 304 have desired tuning or matching characteristics.

Although FIGS. 1 through 3 illustrate examples of sensor devices with helical antennas, various changes may be made to FIGS. 1 through 3. For example, each antenna arm in FIGS. 1 through 3 could include any suitable number of traces and interconnects (which form any suitable number of loops). Also, while shown as including SAW-based sensors, the sensor devices in FIGS. 1 through 3 could include any other or additional types of sensors (such as bulk acoustic wave sensors or other suitable sensors). Further, the relative sizes and shapes of components in FIGS. 1 through 3 are for illustration only. Beyond that, while FIGS. 1 through 3 illustrate various types of helical antennas, other types of helical antennas could be formed in the same or similar manner and used in the sensors devices. In addition, the various sensor devices shown in FIGS. 1 through 3 could be incorporated or integrated into more complex systems (either on the same printed circuit board or other substrate 106-306 or using different printed circuit boards or other substrates). As a particular example, REID components could be used with the sensor devices, enabling more detailed information to be modulated onto wireless signals sent to an interrogation unit or other external device or system. As another particular example, additional active or passive components could be provided in the sensor devices to provide any desired functionality.

Figure 4:
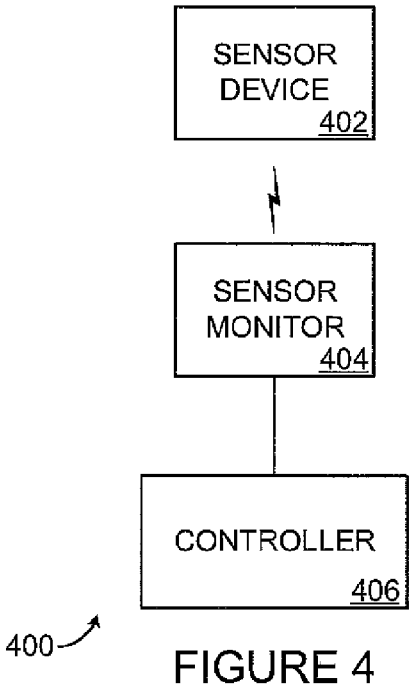
FIG. 4 illustrates an example monitoring system with one or more wireless sensor devices according to this disclosure.

FIG. 4 illustrates an example monitoring system 400 with one or more wireless sensor devices according to this disclosure. The embodiment of the system 400 shown in FIG. 4 is for illustration only. Other embodiments of the system 400 could be used without departing from the scope of this disclosure.

In this example, the system 400 includes at least one sensor device 402. The sensor device 402 could represent any of the sensor devices 100-300 shown in FIGS. 1 through 3 or similar types of sensors.

The sensor device 402 is in wireless communication with a sensor monitor 404. The sensor monitor 404 can transmit wireless signals (such as interrogation signals) to the sensor device 402. The wireless signals could be used by the sensor device 402 to generate operating power for the sensor device 402 (such as through the use of LC resonant circuitry, SAW devices, or other circuitry for generating power). The wireless signals could also be used by the sensor device 402 to generate return wireless signals that are received by the sensor monitor 404. This allows the sensor monitor 404 to intermittently or continuously query the sensor device 402 and to receive wireless signals identifying one or more conditions, materials, or other parameters to be measured. Depending on the implementation, the sensor monitor 404 may or may not analyze the received signals. The sensor monitor 404 includes any suitable structure for providing signals to and/or receiving signals from one or more sensors.

A controller 406 represents a device or system that can use information from the sensor monitor 404 related to the operation of the sensor device 402. For example, if the sensor monitor 404 analyzes the signals received from the sensor device 402, the controller 406 could receive data indicative of the analysis results from the sensor monitor 404. The controller 406 could then log this information, determine if any suitable alarms need to be initiated, adjust operation of a process system, or take any other suitable action based on the data from the sensor monitor 404. If the sensor monitor 404 does not analyze the signals received from the sensor device 402, the controller 406 could also analyze the signals from the sensor device 402 and determine whether various actions need to be taken based on the analysis. The controller 406 could use the information from the sensor monitor 404 in any other or additional manner. The controller 406 includes any hardware, software, firmware, or combination thereof for performing one or more functions based on wireless signals from one or more sensor devices.

Each of the connections between components in FIG. 4 could represent any suitable wired or wireless connection. For example, the sensor monitor 404 could be wired to the controller 406. However, any suitable type of connection could be used between components. Also, any suitable wireless signals could be used to facilitate communications between components in FIG. 4. For instance, radio frequency (RF) or other signals could be exchanged between the sensor device 402 and the sensor monitor 404. As a particular example, RF signals in the range of 433-434 MHz could be used between the sensor device 402 and the sensor monitor 404.

Although FIG. 4 illustrates one example of a monitoring system 400 with one or more wireless sensors, various changes may be made to FIG. 4. For example, a sensor may communicate with any number of monitors, and each monitor could communicate with any number of sensors. Also, any number of monitors could communicate with any number of controllers. In addition, the functional division shown in FIG. 4 is for illustration only. Various components in FIG. 4 could be combined, subdivided, or omitted and additional components could be added according to particular needs. As a specific example, some or all of the functionality of the sensor monitor could be incorporated into the controller or vice versa.

Figure 5:
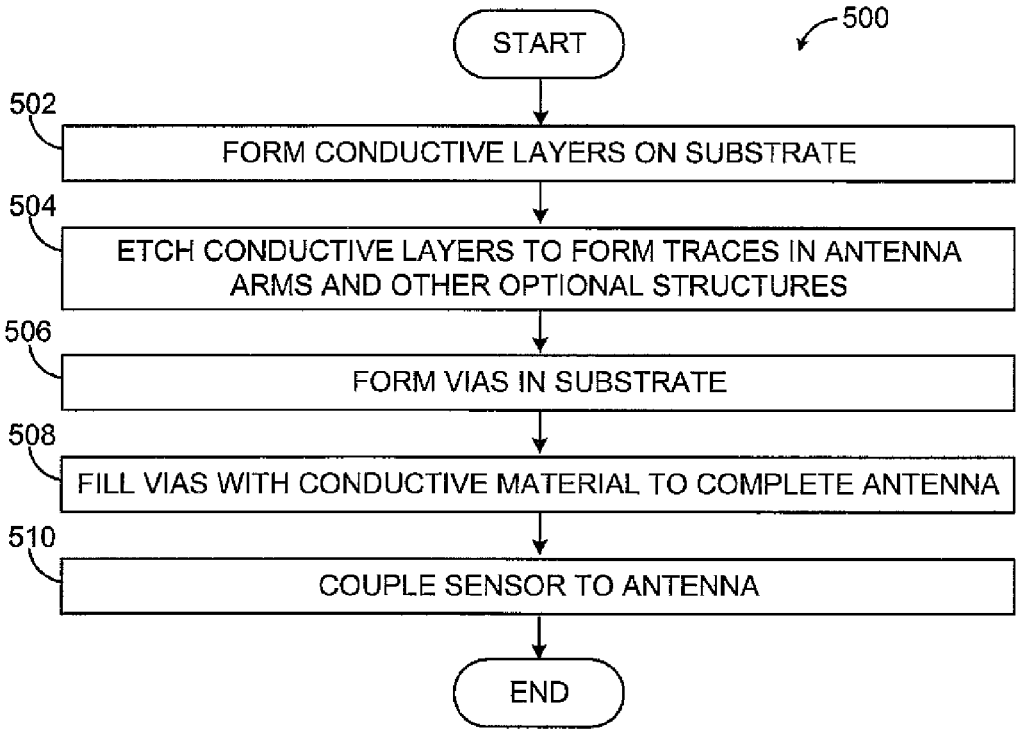
FIGS. 5 and 6 illustrate example methods for fabricating helical antennas according to this disclosure.
Figure 6:
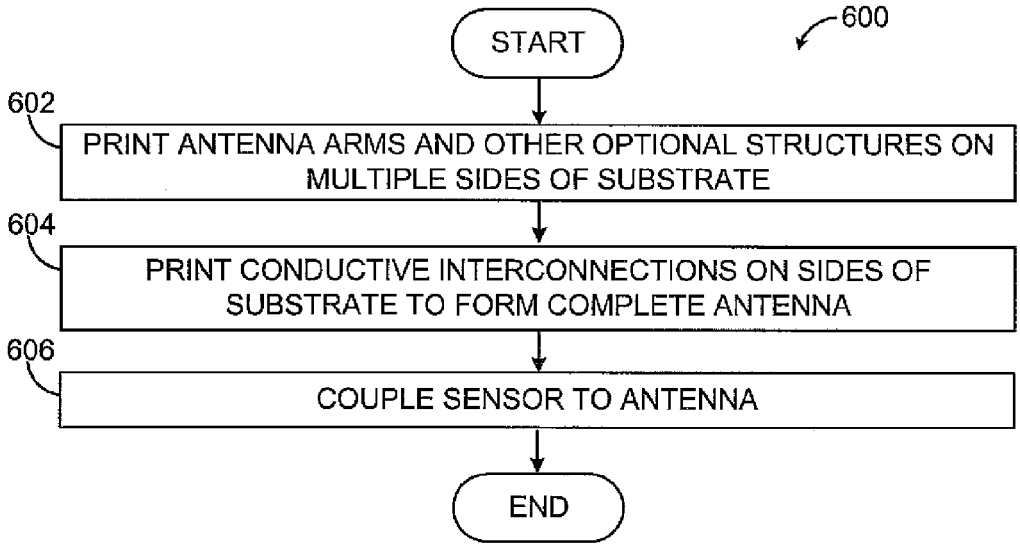

FIGS. 5 and 6 illustrate example methods for fabricating helical antennas according to this disclosure. The embodiments of the methods shown in FIGS. 5 and 6 are for illustration only. Other embodiments of the methods could be used without departing from the scope of this disclosure.

The fabrication techniques shown in FIGS. 5 and 6 are used to form helical antennas, such as those shown in FIGS. 1 through 3. This can be done using subtractive or additive fabrication technology. Using these or other manufacturing technologies can enable low-cost mass production of the helical antennas.

As shown in FIG. 5, a method 500 includes forming conductive layers of material on multiple surfaces of a substrate at step 502. This could include, for example, forming two layers of copper on top and bottom surfaces of a printed circuit board. Any suitable conductive material(s) could be used in this step. Also, any suitable technique could be used to deposit the conductive material(s). In addition, the substrate used here could represent any suitable substrate, such as a rigid double-layer printed circuit board or a metallized flexible substrate.

The conductive layers are etched at step 504. This could include, for example, forming a photolithographic mask over the conductive layers and etching the exposed portions of the conductive layers. The etching forms traces in one or more antenna arms of a helical antenna. The etching can also form one or more ground plates used to form a ground plane in the antenna being fabricated. The etching could further form one or more microstrip connection lines on the substrate.

Vias are formed in the substrate at step 506. This could include, for example, performing a through-the-substrate via formation process to form vias through the substrate. The via formation process could involve any suitable mechano-physico-chemical process. The vias can be positioned so that they connect traces on opposing sides of the substrate. The vias could also be positioned to link a trace to a ground plate or to link multiple ground plates together.

The vias are filled with one or more conductive materials at step 508. This may include, for example, using any suitable via filling process, such as one that fills vias with suitable metal(s) or other conductive material(s). This results in a completed antenna having at least one antenna arm with traces electrically coupled to one another by the interconnects formed in the vias. The completed antenna could also have a ground plate electrically coupled to one or more traces or multiple ground plates electrically coupled to each other by the interconnects formed in the vias.

At this point, a sensor can be coupled to the completed antenna at step 510. This could include, for example, mounting the sensor on the same substrate used to form the antenna. This could also include coupling the sensor to the completed antenna using coaxial cables or one or more microstrip connecting lines (which could be formed on the antenna substrate during the etching of the conductive layers or in any other suitable manner).

In this way, many of the antenna's structures are formed using subtractive fabrication technology. In other words, material is removed from the surfaces of the substrate to form the traces in the antenna arm(s).

As shown in FIG. 6, a method 600 includes printing various portions of an antenna on multiple surfaces of a substrate at step 602. This could include, for example, using a direct printing system to print lines of conductive material(s) on the major surfaces of the substrate. The printed lines could form traces in one or more antenna arms. The direct printing system could also be used to print larger structures onto the substrate, such as one or more ground plates or microstrip connection lines.

Conductive interconnects are printed on one or more sides of the substrate at step 604. This could include, for example, using the direct printing system to print lines of conductive material(s) on the sides of the substrate. The conductive interconnects couple the traces in at least one antenna arm together. The conductive interconnects may also couple one or more ground plates to traces and multiple ground plates to each other. This may form a completed antenna, and a sensor can be coupled to the completed antenna at step 606.

In this way, the antenna's structures are formed using additive fabrication technology. In other words, material is added to the surfaces of the substrate to form the antenna. Depending on the implementation, additive fabrication technology could be less expensive than subtractive fabrication technology since lithography masks may not be required in the additive fabrication technology and direct printing can result in less waste of material.

Although FIGS. 5 and 6 illustrate examples of methods for fabricating helical antennas, various changes may be made to FIGS. 5 and 6. For example, any other or additional techniques could be used to form a helical antenna or portions thereof. Also, the techniques shown in FIGS. 5 and 6 could be combined, such as when an additive technique is used to form some structures of an antenna and a subtractive technique is used to form other structures of the antenna. In addition, while shown as a series of steps, various steps in each figure could overlap, occur in parallel, occur multiple times, or occur in a different order.

Figure 7:
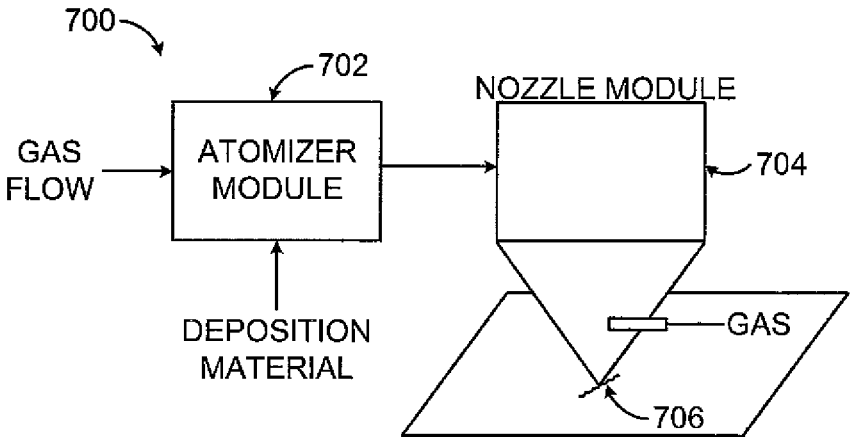
FIG. 7 illustrates an example printing system for additively depositing material on a substrate during antenna formation according to this disclosure.

FIG. 7 illustrates an example printing system 700 for additively depositing material on a substrate during antenna formation according to this disclosure. The embodiment of the printing system 700 shown in FIG. 7 is for illustration only. Other embodiments of the printing system 700 could be used without departing from the scope of this disclosure.

In this example, the printing system 700 represents a direct printing system that can be used to deposit conductive material or other deposition material onto a substrate or other structure without using a mask. As shown here, the printing system 700 includes an atomizer module 702 and a nozzle module 704. The atomizer module 702 mixes at least one deposition material with a gas flow, producing atomized deposition material that is provided to the nozzle module 704. The nozzle module 704 then removes the gas from the atomized deposition material and deposits the deposition material onto a substrate or other structure. In this example, the deposition material is deposited as a liquid line 706 on the substrate or other structure.

It may be noted that the substrate can be rotated as appropriate to position the substrate under the direct printing system 700 to form the antenna structures. In this way, any of the traces, ground plates, and conductive interconnects in a helical antenna can be formed on a substrate using direct printing. The use of a direct printing system to deposit conductive material or other material onto a substrate may be beneficial in several ways. For example, direct printing may require no masking steps to be performed. Also, direct printing may result in little or no paste material being lost during the printing process.

Although FIG. 7 illustrates one example of a printing system 700 for additively depositing material on a substrate during antenna formation, various changes may be made to FIG. 7. For example, other techniques besides direct printing could be used to deposit material onto a substrate or to form a helical antenna.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a sensor configured to receive a first electrical signal and to provide a second electrical signal in response to the first electrical signal, the second electrical signal based on at least one parameter monitored by the sensor; and an antenna configured to convert first wireless signals into the first electrical signal and to convert the second electrical signal into second wireless signals, the antenna comprising:

a single substrate comprising a first half and a second half;

a plurality of conductive traces on first and second surfaces of the first half of the single substrate, the first and second surfaces being opposite and external surfaces of the single substrate;

a plurality of conductive interconnects coupling the conductive traces, the conductive interconnects and the conductive traces forming at least one helical arm of the antenna; and first and second ground plates, the first ground plate on a first surface of the second half of the single substrate and the second ground plate on a second surface of the second half of the single substrate;

wherein, on each of the opposite and external surfaces of the single substrate, all surface area defined between the conductive traces on the first half of the single substrate substantially equals a surface area of one of the ground plates on the second half of the single substrate.

2. The apparatus of claim 1, wherein the conductive traces and the conductive interconnects form one helical arm of a monopole antenna.

3. The apparatus of claim 2, wherein the antenna further comprises at least one additional conductive interconnect coupling the first and second ground plates.

4. The apparatus of claim 1, wherein the conductive interconnects comprise conductive material in vias through the single substrate.

5. The apparatus of claim 1, wherein the conductive interconnects comprise conductive material on sides of the single substrate, the sides between the first and second surfaces of the first half of the single substrate.

6. The apparatus of claim 1, wherein the sensor comprises a surface acoustic wave (SAW) sensor.

7. The apparatus of claim 1, wherein the sensor is directly connected to at least one of the first and second ground plates.

8. A system comprising:

a sensor device configured to receive first wireless signals and to transmit second wireless signals in response to the first wireless signals, the sensor device comprising an antenna, the antenna comprising:

a single substrate comprising a first half and a second half;

a plurality of conductive traces on first and second surfaces of the first half of the single substrate, the first and second surfaces being opposite and external surfaces of the single substrate;

a plurality of conductive interconnects coupling the conductive traces, the conductive interconnects and the conductive traces forming at least one helical arm of the antenna; and first and second ground plates, the first ground plate on a first surface of the second half of the single substrate and the second ground plate on a second surface of the second half of the single substrate; and a sensor monitor configured to transmit the first wireless signals to the sensor and to receive the second wireless signals from the sensor;

wherein, on each of the opposite and external surfaces of the single substrate, all surface area defined between the conductive traces on the first half of the single substrate substantially equals a surface area of one of the ground plates on the second half of the single substrate.

9. The system of claim 8, further comprising:

a controller configured to analyze data associated with the second wireless signals and to control a process system based on the analysis.

10. The system of claim 8, wherein the conductive traces and the conductive interconnects form one helical arm of a monopole antenna.

11. The system of claim 10, wherein the antenna further comprises at least one additional conductive interconnect coupling the first and second ground plates.

12. The system of claim 8, wherein the conductive interconnects comprise conductive material in vias through the single substrate.

13. The system of claim 8, wherein the conductive interconnects comprise conductive material on sides of the single substrate, the sides between the first and second surfaces of the first half of the single substrate.

14. The system of claim 8, wherein the sensor comprises a surface acoustic wave (SAW) sensor.

15. The system of claim 8, wherein the sensor is directly connected to at least one of the first and second ground plates.

16. A method comprising:

receiving first wireless signals at a sensor device; and responsive to receiving the first wireless signals, transmitting second wireless signals from the sensor device;

wherein the sensor device comprises an antenna, the antenna comprising:

a single substrate comprising a first half and a second half;

a plurality of conductive traces on first and second surfaces of the first half of the single substrate, the first and second surfaces being opposite and external surfaces of the single substrate;

a plurality of conductive interconnects coupling the conductive traces, the conductive interconnects and the conductive traces forming at least one helical arm of the antenna; and first and second ground plates, the first ground plate on a first surface of the second half of the single substrate and the second ground plate on a second surface of the second half of the single substrate;

wherein, on each of the opposite and external surfaces of the single substrate, all surface area defined between the conductive traces on the first half of the single substrate substantially equals a surface area of one of the ground plates on the second half of the single substrate.

17. The method of claim 16, wherein the conductive traces and the conductive interconnects form one helical arm of a monopole antenna.

18. The method of claim 17, wherein the antenna further comprises at least one additional conductive interconnect coupling the first and second ground plates.

19. The method of claim 16, wherein the sensor is directly connected to at least one of the first and second ground plates.

* * * * *